US006223488B1

(12) United States Patent
Pelfrey et al.

(10) Patent No.: US 6,223,488 B1
(45) Date of Patent: May 1, 2001

(54) VENTED SIDING

(75) Inventors: Paul R. Pelfrey, Pickerington; David J. Knecht, Johnstown, both of OH (US)

(73) Assignee: Crane Plastics Siding LLC, Columbus, OH (US)

( * ) Notice: Subject to any disclaimer, the term of this patent is extended or adjusted under 35 U.S.C. 154(b) by 0 days.

(21) Appl. No.: 09/456,637

(22) Filed: Dec. 9, 1999

(51) Int. Cl.[7] ..... E04B 1/70; E04D 1/00
(52) U.S. Cl. ..... 52/302.1; 52/536
(58) Field of Search ..... 52/302.1, 536, 52/537, 539, 558, 559

(56) References Cited

U.S. PATENT DOCUMENTS 3,159,943 * 12/1964 Sugar et al. ..... 52/302.1 X
3,246,436 * 4/1966 Roush ..... 52/302.1
3,289,380 * 12/1966 Charniga ..... 52/302.1 X
4,102,106 * 7/1978 Golder et al. ..... 52/539 X
4,188,762 2/1980 Tellman .
4,930,287 6/1990 Volk et al. .
5,016,415 5/1991 Kellis .
5,022,207 * 6/1991 Hartnett ..... 52/537
5,303,525 * 4/1994 Magee ..... 52/533 X
5,809,731 * 9/1998 Reiss ..... 52/302.1 X
5,946,876 9/1999 Grace, Sr. et al. .
5,956,914 9/1999 Williamson .

* cited by examiner

*Primary Examiner*—Robert Canfield
(74) *Attorney, Agent, or Firm*—Standley & Gilcrest LLP

(57) ABSTRACT

An exterior covering for buildings and the like is described. The present invention relates to vinyl siding panels for building exteriors that are easy to install, and which prevent a collection of moisture along the building exterior.

12 Claims, 2 Drawing Sheets

VENTED SIDING

BACKGROUND AND SUMMARY OF THE INVENTION

The present invention relates generally to exterior coverings for buildings and the like. Specifically, this invention relates to vinyl siding panels for building exteriors that are easy to install and prevent a collection of moisture along the building exterior.

It is a common practice to cover the exterior vertical surfaces of a building with aluminum or vinyl siding in order to both protect the building exterior and to provide a durable, aesthetically pleasing finish. Conventional siding consists of long strips, generally between six and twelve inches in height, which are attached one by one to the exterior of a building. The application of individual strips is an expensive, time-consuming process.

These elongated strips interlock with one another, sufficiently creating a seal between strips. This seal prevents the escape of any water that may leak behind the siding, or any water that collects behind the siding due to condensation. This collected water can over time cause damage to the building exterior intended to be protected by the siding.

It is therefore an object of the present invention to develop siding for building exteriors that covers a greater surface area than individual strips, thereby requiring less installation time, and that prevents any collection of water behind the siding.

A preferred embodiment of a vented siding panel to be attached to a sufficiently vertical building substrate of the present invention comprises: (1) a thin, elongated rectangular body having an inner and outer face, and an upper and lower longitudinal edge, said rectangular body having a longitudinal length sufficiently greater than the lateral height of the rectangular body; (2) a substantially flat portion along the upper longitudinal edge of the rectangular body, the substantially flat portion adapted to be parallel to and substantially contact the vertical building substrate; (3) a plurality of openings in the substantially flat portion adapted to enable the passage of fastening devices; (4) a C-shaped portion parallel to and below the substantially flat portion, the C-shaped portion extending outward from the outer face and terminating in a downward position; (5) a U-shaped portion extending along the bottom longitudinal edge of the vertical body, the U-shaped portion terminating in an upward position along the inner side of the rectangular panel and adapted to engage and connect with the C-shaped portion of an adjacent vented siding panel; (6) a substantially planar portion extending longitudinally between the C-shaped portion and the U-shaped portion, the substantially planar portion being sufficiently parallel to and separated a distance from the building substrate; (7) at least one longitudinal groove in the substantially planar portion having sufficiently horizontal upper and lower sections and a sufficiently vertical section, the sufficiently vertical section adapted to sufficiently contact the building substrate, the longitudinal groove positioned laterally in the rectangular siding panel so as to separate the substantially planar section into evenly spaced planar sections; and (8) a plurality of outwardly extending flaps in the sufficiently horizontal upper and lower sections of a longitudinal groove, outwardly extending flaps adapted to extend into the longitudinal groove, the flaps being cut from the rectangular siding panel thereby creating a plurality of open areas in the rectangular siding panel. The siding panel may be of any appropriate material, such as vinyl, aluminum, or plastic. The panels may also come in a number of colors or textures.

In addition to the novel features and advantages mentioned above, other objects and advantages of the present invention will be readily apparent from the following descriptions of the drawings and preferred embodiments.

DETAILED DESCRIPTION OF PREFERRED EMBODIMENT(S)

Figure 2:
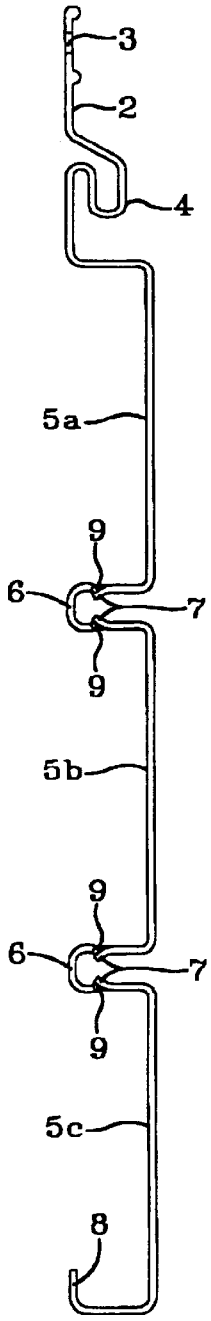
FIG. 2 is a side view of a vinyl siding-panel that may be used in accordance with one embodiment of the present invention.
Figure 1:
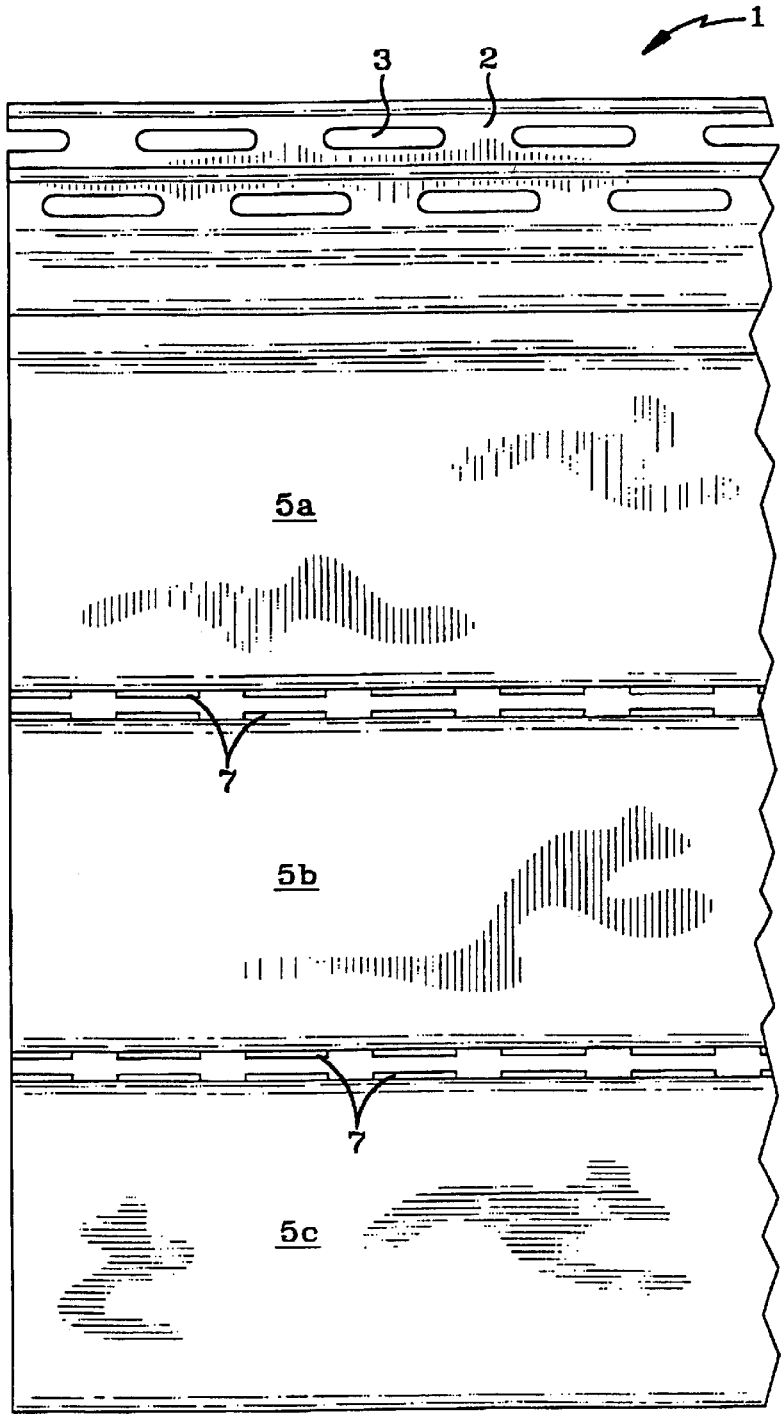
FIG. 1 is a partial front view of a vinyl siding panel that may be used in accordance with one embodiment of the present invention.

The present invention is directed to exterior coverings for buildings and the like that are easy to install, and which prevent a collection of moisture along the building exterior. FIG. 1 shows one embodiment of a vinyl siding panel 1 of the present invention. A preferred embodiment of a vinyl siding panel 1 of the present invention includes a thin, elongated rectangular vinyl panel having an inner and outer face, and an upland lower longitudinal edge. The longitudinal length of the panel is preferably sufficiently greater than its lateral height. The panel preferably has a substantially flat portion 2 along the upper longitudinal edge of the panel, the substantially flat portion 2 adapted to be parallel to and substantially contact the vertical building substrate. The substantially flat portion 2 preferably has a plurality of openings 3 adapted to enable the passage of fastening devices such as nails or screws. FIG. 2 shows a C-shaped portion 4, which may be parallel to and just below the substantially flat portion 2, the C-shaped portion 4 extending outward from the outer face and terminating in a downward position.

A U-shaped portion 8 preferably extends along the bottom longitudinal edge of the vertical panel, the U-shaped portion 8 terminating in an upward position along the inner side of the rectangular panel and adapted to engage and connect with the C-shaped portion of an adjacent vented siding panel. A substantially planar portion preferably extends longitudinally between said C-shaped portion 4 and said U-shaped portion 8, the substantially planar portion sufficiently parallel to and separated a distance from the building substrate. In a preferred embodiment, the panel has two longitudinal grooves 6 in the substantially planar portion. FIG. 1 shows the two longitudinal grooves 6 dividing the substantially planar portion into three equal planar sections 5*a*, 5*b*, and 5*c*, each of these sections adapted to appear as individual siding strips.

Figure 3:
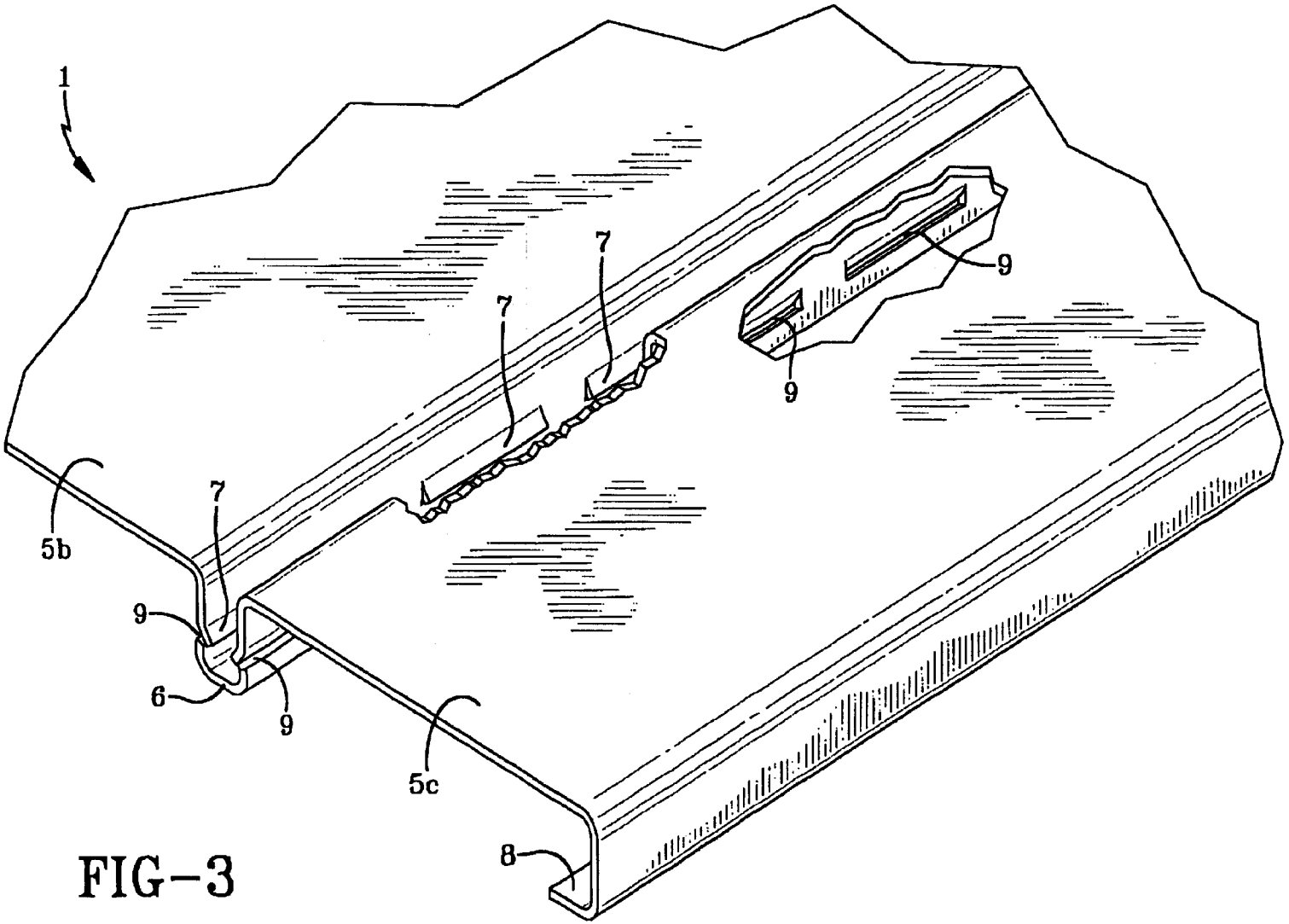
FIG. 3 is a perspective view of a vinyl siding panel that may be used in accordance with one embodiment of the present invention.

FIG. 3 shows a closer view of a groove 6 of the present invention. The longitudinal groove 6 preferably has sufficiently horizontal upper and lower sections and a sufficiently vertical rear section, the sufficiently vertical rear section adapted to sufficiently contact the exterior building substrate. The longitudinal groove preferably has a plurality of outwardly extending flaps 7 in the sufficiently horizontal upper and lower sections, the outwardly extending flaps 7 adapted to extend into the longitudinal groove 6. The outwardly extending flaps 7 may be cut from the rectangular siding panel, thereby creating a plurality of open areas 9 in the rectangular siding panel. The openings 9 in the horizontal upper section of a longitudinal groove 6 may allow any water or condensate to drain from behind the section of the panel above that groove. The openings 9 in the horizontal lower section of a longitudinal groove 6 preferably allow air to circulate behind the panel to prevent condensation and allow the escape of any water vapor. The flaps 7 are preferably bent toward the rear of the panel and preferably cover a significant portion of each opening, thereby preventing water from running behind the panel. It is also preferred that the vents be sufficiently small so as to minimize their obviousness to an observer.

The preferred embodiments herein disclosed are not intended to be exhaustive or to unnecessarily limit the scope of the invention. The preferred embodiments were chosen and described in order to explain the principles of the present invention so that others skilled in the art may practice the invention. Having shown and described preferred embodiments of the present invention, those skilled in the art will realize that many variations and modifications may be made to affect the described invention. Many of those variations and modifications will provide the same result and fall within the spirit of the claimed invention. It is the intention, therefore, to limit the invention only as indicated by the scope of the claims.

What is claimed is:

1. A vented siding panel to be attached to a building substrate, said vented siding panel comprising:

a) thin, elongated rectangular body having an inner and outer face, and an upper and lower longitudinal edge, said rectangular body having a longitudinal length greater than the lateral height of said rectangular body;

b) at least one longitudinal groove in said rectangular body, said at least one longitudinal groove positioned laterally in said rectangular body so as to separate said rectangular body into evenly spaced planar sections; and c) a plurality of upper and lower openings in said at least one longitudinal groove.

2. A vented siding panel according to claim 1 additionally comprising a substantially flat portion along said upper longitudinal edge of said rectangular body, said substantially flat portion adapted to be parallel to and substantially contact said building substrate.

3. A vented siding panel according to claim 2 additionally comprising a plurality of openings in said substantially flat portion, said openings adapted to enable the passage of fastening devices.

4. A vented siding panel according to claim 1 additionally comprising a C-shaped portion parallel to and below said upper longitudinal edge, said C-shaped portion extending outward from said outer face and terminating in a downward position.

5. A vented siding panel according to claim 1 additionally comprising a U-shaped portion extending along said lower longitudinal edge of said rectangular body, said U-shaped portion terminating in an upward position along the inner face of said rectangular body and adapted to engage and connect with a portion of an adjacent vented siding panel.

6. A vented siding panel according to claim 5 wherein said portion of an adjacent vented siding panel comprises a C-shaped portion of an adjacent vented siding panel.

7. A vented siding panel according to claim 1 additionally comprising a substantially planar portion extending longitudinally along said rectangular body.

8. A vented siding panel according to claim 1 wherein said at least one longitudinal groove comprises substantially horizontal upper and lower sections and a substantially vertical section, said substantially vertical section adapted to contact said building substrate.

9. A vented siding panel according to claim 1 additionally comprising outwardly extending flaps in said at least one longitudinal groove.

10. A vented siding panel according to claim 9 wherein said plurality of outwardly extending flaps are located within horizontal upper and lower sections of said at least one longitudinal groove, said outwardly extending flaps adapted to extend into said at least one longitudinal groove.

11. A vented siding panel according to claim 9 wherein said plurality of upper and lower openings are located within horizontal upper and lower sections of said at least one longitudinal groove.

12. A vented siding panel according to claim 9 wherein said outwardly extending flaps are cut from said rectangular body, thereby creating said plurality of upper and lower openings.

* * * * *